United States Patent [19]

Silverbush

[11] 4,135,287

[45] Jan. 23, 1979

[54] METHODS OF ATTACHING SNAP FASTENERS

[75] Inventor: Herbert M. Silverbush, Cranston, R.I.

[73] Assignee: Rau Fastener, A Division of U.S. Industries, Inc., Providence, R.I.

[21] Appl. No.: 869,853

[22] Filed: Jan. 16, 1978

Related U.S. Application Data

[62] Division of Ser. No. 761,807, Jan. 24, 1977, Pat. No. 4,090,652.

[51] Int. Cl.[2] ..... A41H 37/04

[52] U.S. Cl. ..... 29/432; 29/281.1; 29/464; 29/526 R; 227/18; 29/407

[58] Field of Search ..... 29/281.1, 706, 798, 29/809, 822, 407, 432, 464, 526, 823, 281.5; 227/15, 18, 40, 48, 57, 119

[56] References Cited

U.S. PATENT DOCUMENTS

| | | | |
|---|---|---|---|
| 3,045,856 | 7/1962 | Cornell | 227/57 |
| 3,209,975 | 10/1965 | Tlumacki | 227/57 |
| 3,225,993 | 12/1965 | Hall | 227/18 |
| 3,992,765 | 11/1976 | Silverbush | 29/407 |

*Primary Examiner*—Michael J. Keenan

*Attorney, Agent, or Firm*—Arthur L. Plevy

[57] ABSTRACT

A snap fastener attaching system employs a moveable carriage assembly which is controlled in linear motion by a belt system coupled to an actuator mechanism. The carriage assembly includes clamping means which are sequentially operated to clamp a garment on the assembly after emplacement by an operator. The depression of a start button enables the actuator to traverse a shaft. Associated with the actuator is a pivotable arm which is located in proximity to a selected shaft of a cam-containing turret assembly. As the actuator moves, the carriage moves proportionately due to the belt coupling system. Each time the actuator arm contacts a cam along the turret shaft, a fastener is emplaced on the garment by the snap fastener attaching machine associated with the carriage assembly. When the last fastener is emplaced, the apparatus is automatically returned to the starting position to enable accommodation of the next garment. The attaching system employs adjustable guide mechanisms and a turret can be selectively activated to enable the apparatus to accommodate different size garments; while further including a conveyor or garment handling assembly for automatically transporting the garment from one machine to another for attaching corresponding counterparts to the garment.

25 Claims, 13 Drawing Figures

Fig. 1.
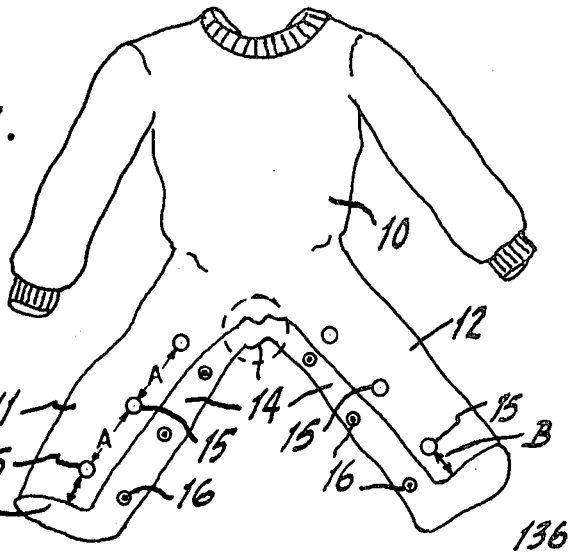
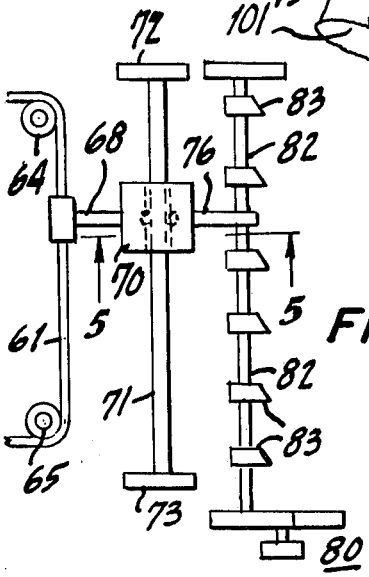
Fig. 4.
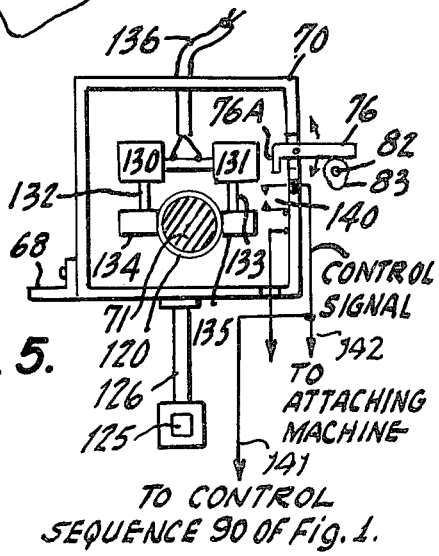
Fig. 5.
Fig. 3.
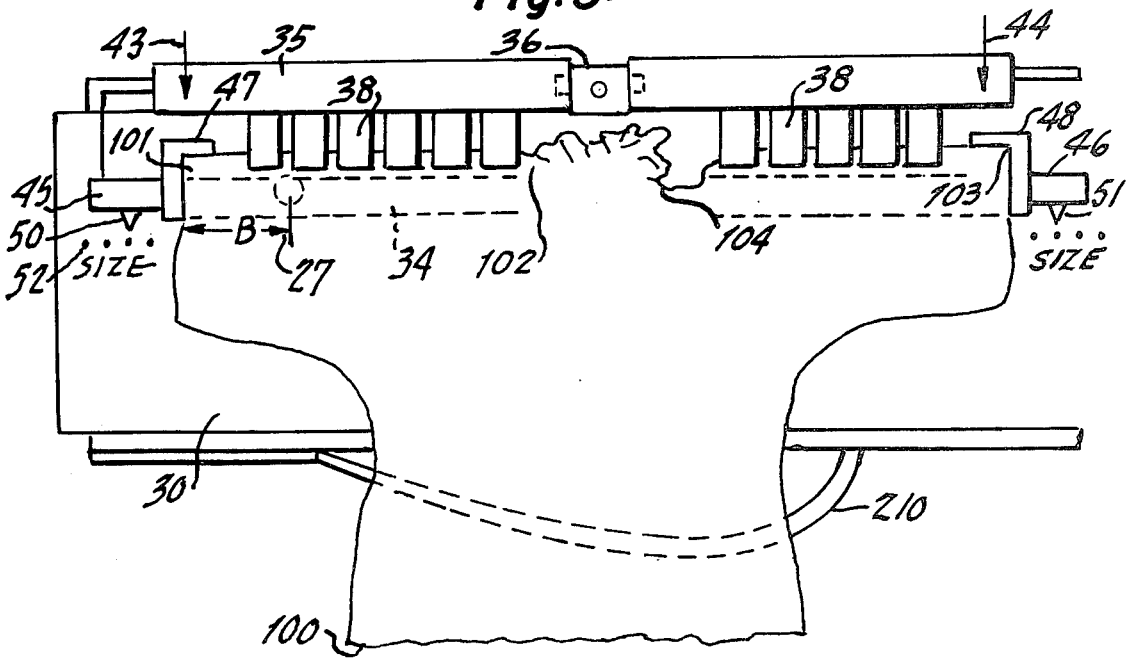

METHODS OF ATTACHING SNAP FASTENERS

This is a divisional of application Ser. No. 761,807, filed on Jan. 24, 1977, now U.S. Pat. No. 4,090,652.

BACKGROUND OF INVENTION

This invention relates to snap fastening apparatus and more particularly to an automatic snap fastener attaching system particularly adapted to secure fasteners to a garment at predetermined intervals according to the size of the garment. The snap fastener has achieved wide spread use in the garment industry and in many applications has replaced the button and other conventional fastening devices due to the fact that the fastener is simply operated, easy to construct, and is reliable and rugged in use.

Hence, the snap fastener is employed in a great variety of garments and has acheived wide spread use. A particular type of garment upon which snap fasteners are employed is referred to as a youth garment. As is known, there are many manufacturers who design and manufacture clothing for youngsters from infancy to about twenty-four months of age or so. It is of course, understood that youngsters in this range are subject to relatively rapid growth and hence, there is a substantial change in size between an infant and a youngster of two years or so.

Furthermore, most of the garments must contain provisions to permit access to the child's diapers and so on when the garment is being worn. As such, these garments which are sometimes referred to as creepers, sleepers and crawlers have a plurality of snap fastening devices on the inside periphery of the leg portion of the garment. This is to enable one to quickly open the garment for the purposes of changing or diapering the child during the course of the day. The emplacement of such fasteners during the manufacturing process is a relatively complicated and difficult job.

As is known, a typical fastener comprises two parts to enable closure of a garment. One part, which may be referred to as a female fastener section is emplaced near one edge of the garment and another part designated as a male fastener section would be emplaced on a corresponding edge of another part of the garment. When the female and male parts are coacting, the garment is secured or closed at that point.

Thus, in order to accomplish the emplacement of such fasteners, one has to properly align the female parts on one surface of a garment and the male parts on a corresponding other surface of the garment. These parts must be in relatively close alignment to assure that the garment closure presents a uniform and pleasing appearance when the male and female parts are thusly secured.

In order to accomplish this in regard to the above described youngster's clothing, the prior art employed a single operator who would operate two separate snap fastener attaching machines. The operator, based on skill, would then individually emplace both the male and the female fasteners on the garment at the proper locations based mainly upon her judgment as to spacing or based upon a preset marking which might be emplaced upon the garment at the proper locations prior to emplacement of the snap fasteners. This was a realtively time consuming and complicated technique which involved operator skills.

The problem is further complicated by the fact, as indicated above, that if the size of the garment changed as a function of the age of the child, then the spacing of the fasteners would have to change accordingly. Such size considerations and so on were implemented according to the ability and discretion of the operator and hence, it would not be uncommon to employ different operators to operate different machines according to the particular size of the garment being manufactured.

It is therefore an object of the present invention to provide a relatively automatic snap fastener attachment system particularly adapted for emplacing fasteners on youngster type garments; which apparatus possesses a capability of automatic accommodation of size changes while further assuring that the garment, once positioned in the apparatus, will have emplaced thereon the requisite number of fasteners, each emplaced at the proper distance and separation strictly according to the size of the garment being manufactured.

Other objectives of the present invention will become clearer upon reading the specification wherein further details of the nature of this particular problem are more fully described.

BRIEF DESCRIPTION OF PREFERRED EMBODIMENT

A system for attaching snap fasteners about an elongated edge of a piece of material employs a snap fastener attaching machine of the type including means for positioning a front fastener part at an emplacement location and for positioning a second part spaced from said first part at a corresponding location, the spacing between the parts sufficient for insertion of a garment material therein, emplacement means associated with the attaching machine that when activated are operative to emplace the first and second parts on the inserted garment. In conjunction with this apparatus is apparatus for automatically emplacing a plurality of fastener parts about said edge at predetermined intervals comprising a planar member having a longitudinal slot of a given length on a surface thereof, said member positioned between said first and second part locations on said attaching means with said slot located in communication with said emplacement area, a first and a second selectively actuated clamping means located on said surface of said planar member and directed along and relatively parallel to said slot, a right and a left adjustable guide means positioned on said surface of said planar member with said right guide means positioned at the right of said slot and said left guide means positioned on the left of said slot, for enabling the alignment of a right end edge of said material by said right guide and alignment of a left end edge by said left guide, means for selectively operating a first one of said clamping means upon alignment of an associated end edge of said material and for selectively activating said other clamp for alignment of said other edge after activation of said first one of said clamping means, and means for providing relative motion between said planar member and said attaching means and operative to emplace said fastener parts about said edge of said clamped garment during said movement at selected predetermined intervals. In conjunction with the above described apparatus is a method for clamping the material and the garment of the type specified prior to attachment of the snap fastener by first clamping said material from said first end towards said second end for a given distance along said edge, then clamping said material from said second end towards said first end for a given distance along said edge whereby all material not clamped is accumulated between said first and second ends and emplacing snap fastener parts at predetermined intervals only along said clamped edges in a direction commencing from said first end to said second end whereby said material not clamped has no fastener parts attached thereto.

BRIEF DESCRIPTION OF FIGURES

FIG. 1 is a plan view depicting a garment having a plurality of fasteners secured thereto by apparatus according to this invention.

FIG. 3 is a top plan view of a clamping mechanism supporting a garment according to this invention.

FIG. 4 is a top schematic view of an actuator traversing a shaft under control of a cam assembly.

FIG. 5 is a partial cross-sectional view of an actuator propelling mechanism.

DETAILED DESCRIPTION OF FIGURES

Referring to FIG. 1, there is shown a typical youngster's garment 10 which as indicated may be referred to as a creeper, a sleeper, or a crawler type of garment and would be used to clothe a youngster, for example, of up to twenty-four months or more or less in age. The nature of the garment, as can be ascertained from FIG. 1, is relatively conventional and should be quite familiar to most persons.

Essentially, such garments have the capability of permitting easy access to the youngster for purposes of diapering or changing the child during the course of the day. As such, the leg portions 11 and 12 of the garment have an internal peripheral opening to enable the separation of the inner seam location for the purposes of diapering or changing the child. As shown in FIG. 1, the inner peripheral area designated as 14 is not sewn or secured in a permanent manner and is opened or closed by means of snap fasteners.

Shown located about the periphery of area 14 are a series of corresponding snap fastening parts which would enable a user to selectively secure or open the peripheral area 14 as desired. By way of example, a series of male fasteners as 15 would be emplaced at the edge of one portion of the inner leg area while a series of corresponding fasteners as 16 would be emplaced on the corresponding portion of the leg area about the periphery.

As can be ascertained from the FIG., the spacing A from one fastener location to another is predetermined and may vary depending upon the garment size. Accordingly, one would desire to employ the same number of total fastening elements on each garment relatively independent of the size of the garment.

Shown encircled in dashed lines is the crotch area of the garment. Since the spacing of the fasteners one from the other is relatively fixed and predetermined, any excess of material and so on is accommodated within the crotch area. This, of course, enables the child or youngster to wear diapers which bulge or protrude and still permits the securing of the fastener assemblies as 15 and 16 to present as uniform an appearance as possible.

As also will be explained further, the distance indicated as B from the bottom edge of the garment to the location of the corresponding closest fastener is also predetermined and selected according to the garment size. Hence, once the first fastener is emplaced at the distance B from each edge, the positions of the remaining fasteners are automatically specified. Since the fasteners as 15 and 16 are to be emplaced as shown about an inside peripheral area, one must assure that the excess material is accommodated and present mainly in the crotch area as above indicated and as will be further explained.

Figure 2:
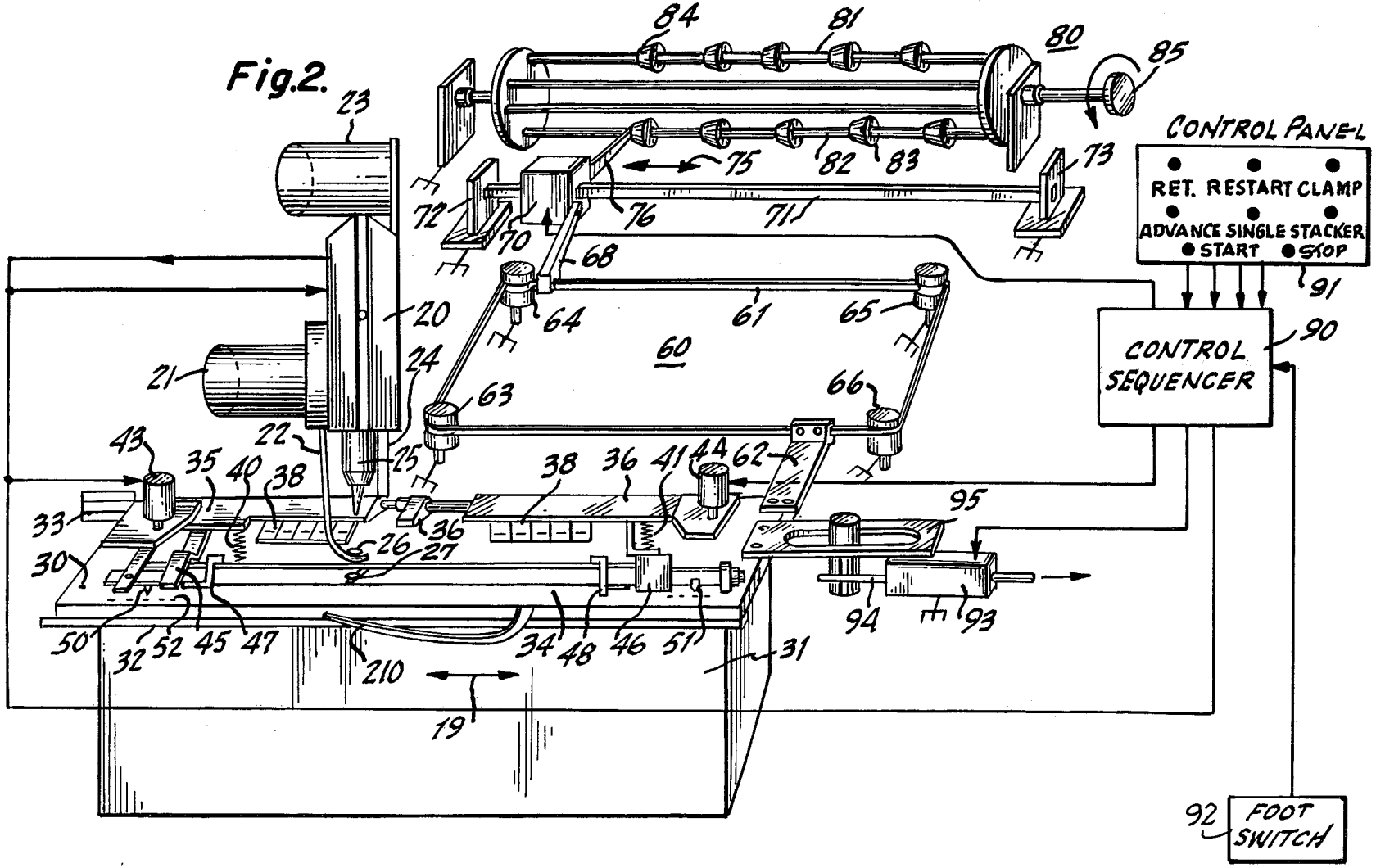
FIG. 2 is a detailed partial perspective and diagrammatic view of a snap fastener attaching system according to this invention.

Referring to FIG. 2, there is shown a schematic diagram of a system according to this invention which enables the automatic placement of a number or combination of snap fasteners on a garment with the further capability of accommodating various size garments on the same apparatus.

Basically, the system shown in FIG. 2 employs a conventional snap fastener attachment machine 20. The snap fastener attaching machine 20 is well known and extensively used in the industry for the purpose of emplacing the requisite parts of a snap fastener on a garment.

The garment to which such fasteners are to be attached is conventionally directed through the machine by an operator. The operator by activating the switch or a foot pedal causes a fastener assembly to be secured on the garment at a desired location. As indicated above, this location may also be selected by the operator.

Basically, the automatic fastener machine serves to direct fastener parts from suitable hoppers and aligns them one above the other. In a conventional machine, the activation of a foot switch or pedal permits the machine to perform an attaching operation to secure the fastener to the garments.

The mechanisms and operation of such snap fastener attaching machines as 20 are well known and many manufacturers including the Assignee herein, have provided such machines for many years. An example of a prior art fastener machine which will perform the above noted operation is manufactured by Rau Fastener, A Division of U.S. Industries Company of Rhode Island and is designated as Model 6N Snap Fastener Attaching Machine.

In the system to be described, the snap fastener attaching machine 20 is of a conventional type as above indicated. Basically, the machine includes a first hopper 21 which serves to accommodate a large number of front fasteners. The hopper 21 is associated with a feed tube or feed conveyor 22.

The machine also includes a socket hopper 23 which holds a large number of socket members. The socket hopper 23 is also associated with a feed tube or conveyor 24.

The hoppers and feed tubes are conventionally controlled by means of a hopper feed assembly which may be contained in a suitable housing and is motor operated and usually contains a clutch mechanism to assure operation of the unit when both fastener parts are properly positioned as shown in the drawing.

A punch or die member 25 is positioned above the fastener parts as 26 and 27 and when activated, moves to emplace a fastener assembly on a garment located between parts 26 and 27. Thus, as can be seen from the FIG., the corresponding parts of a fastener assembly as 26 and 27 are held one above the other and then emplaced by the actuation of the punch or die member 25.

In a typical snap fastener attaching machine as 20 the emplacement is usually accomplished at a predetermined work area. In this apparatus, the actuating mechanism for the attaching machine 20 is retained. However, the work area, as will be described, is charactized by a moveable carriage assembly 30 to accommodate garments of the type described above or garments as shown in FIG. 1; which snap fastener assemblies are to be placed about the periphery of a biased area or a region as shown in FIG. 1.

Essentially, the carriage assembly 30 is a relatively flat planar member. The carriage assembly 30 is slideably moveable in the directions shown by arrow 19 with respect to a rigid base 31 which serves to support the assembly as is shown. The carriage assembly 30 rides and is supported within suitable channel members as 32 and 33 enabling the carriage assembly to move in the horizontal plane in the directions depicted by arrow 19.

Located on the surface of the carriage assembly 30 is a horizontal extending slot 34. As can be seen from the FIG., the slot 34 enables the emplacement of the fastener part 27 with the fastener part 26 when a garment is inserted on the surface of the carriage assembly 30.

Also located on the surface of the carriage assembly 30 is a left clamp member 35 and a right clamp member 36. In essence, the clamp members 35 and 36 can be independently activated as will be explained. The clamp members 35 and 36 are pivotably mounted with respect to the carriage assembly 30. A pivot point is formed relatively centrally by means of a pivot block 36. Each clamp has a plurality of extending fingers as 38 which are fabricated from a spring steel or other compliant material and are used to grasp and hold the garment when the garment is emplaced on the carriage assembly and when the clamp is activated, as will be explained. Each clamp member 35 and 36 is biased in an open position by means of springs as 40 and 41.

Shown at the extreme end of the clamp assemblies 35 and 36 are a respective actuating device 43 and 44. The devices 43 and 44 may be pneumatic cylinders or electrical solenoids and when activated push down on the clamp to overcome the force exerted by the associated springs as 40 and 41 to thereby close the clamp or move the clamp towards the surface of the carriage assembly.

As will be explained, the left clamp 35 operates independently from the right clamp 36. The clamps 35 and 36 are in fact, operated in sequence at the command of the operator when emplacing a garment on the carriage assembly 30.

Also shown on the carriage assembly 30 is a right hand adjustable guide assembly 46 and a left hand adjustable guide assembly 45. The guide assemblies 45 and 46 are moveably mounted on the carriage assembly 30 and as will be explained, are moved according to the size of the garment to be accommodated. As such, each guide assembly has a front gauge bar as 47 and 48 attached thereto. The gauge bars are of an inverted "L" configuration and are used by the operator to align the edge of the garment.

As can be seen from the FIG., the adjustable guide assemblies 45 and 46 each have a marker member as 50 and 51 associated therewith. The markers are set to any one of a series of size markers as 52 located on the surface of the carriage assembly 30. The size markers 52 are preset according to the various size garments to be accommodated.

As indicated above, the carriage assembly 30 being supported and positioned within the track members 32 and 33, can move in the directions indicated by arrow 19. The motion of the carriage assembly 30 is accommodated and controlled by means of a drive assembly system 60. The carriage assembly 30 is directly coupled to a moveable belt 61 by means of a typical clamping bar arrangement 62. As shown, the clamping arrangment 62 may comprise a central arm which is attached to a circular clamp section for firmly and rigidly coupling the carriage assembly 30 to the belt 61.

The belt is directed about four idler members 63, 64, 65 and 66. The idlers are rotatably mounted with respect to the base member 31 of the unit and hence, the belt 61 can be moved about the idlers in either a clockwise or counterclockwise direction. The movement of the belt is controlled by an actuator member 70. The member 70 is propelled along a shaft 71 which is supported at its ends by means of supporting blocks 72 and 73 which are located at a predetermined distance one from the other and rigidly secured to the frame or reference plane 31. The actuator can therefore move as will be further explained, on the shaft 71 in the directions designated by the arrow 75.

The actuator 70 is coupled to the belt 61 by means of an extending bracket 68 which is secured to the actuator and which at the other end, encircles and is rigidly coupled to the belt 61. Thus, as the actuator moves and since the carriage assembly 30 is secured to the belt by means of bracket 62, the carriage assembly will also move.

Associated with actuator assembly 70 is an extending actuator arm 76.

Shown located relatively parallel and proximate to the shaft 71 and the actuator assembly 70 is a turret mechanism 80. As can be seen, the turret mechanism 80 contains a plurality of parallel bars as 81 and 82. There may be, of course, many other bars as will be explained, but for purposes of simplicity, only two bars have been functionally presented. Each bar as 81 and 82 has located thereon a plurality of cam control members as 83 and 84. The cam members are emplaced on the bars in predetermined fixed positions with respect to each other.

The entire turret assembly operates by means of a control knob 85 which includes a detent for rotation of the turret assembly to emplace a given bar as 81 or 82 with its associated prespaced cam members in an operational relationship with respect to the extending arm 76 of the actuator 70.

From the above noted description, it can be seen that to accommodate various garment sizes, one has to set the adjustable guide assemblies 45 and 46 according to the size of the garment and rotate the turret assembly 80 accordingly. These two simple adjustments by the operator will place an attaching machine, as will be explained, in the correct sequence for emplacing appropriate fastener parts on a garment inserted on the carriage assembly 30.

The operation and control of the various mechanisms above described and as will be explained in further detail, is implemented by means of a control sequencer 90 which is associated with a control panel 91 and a foot switch or other device 92. Before explaining in detail the sequence of operation, it is, of course, understood that apart from the mechanical assembly thus depicted, the control sequencer can operate by means of electronics or electromechanical relays or by pneumatic devices and so on.

Also shown in the FIG. and under control of sequencer 90 is a pneumatic or electrical solenoid 93 which has its moveable arm 94 rigidly secured to a bracket 95 which is secured to the carriage assembly 30. As will be explained, the function of the unit 93 is to initially move the carriage 30 a predetermined distance to the right to accurately position the same for emplacement of the first fastener assembly on the garment.

The description of the operation of the apparatus will be given and reference will be made to the following figures as well as FIG. 2 thus described.

FIG. 3 depicts an emplaced garment on the carriage assembly 30, which garment has been clamped as will be explained, by means of the left clamp 35 and the right clamp 36.

It is noted that the figures have been simplified for ease of explanation and similar reference numerals have been retained for the sake of clarity and consistency in describing the mecanism.

Thus, in FIG. 3 various parts shown in FIG. 1 have been omitted but will be discussed where pertinent.

FIG. 3 shows a top view of a garment 100 clamped into position on the surface of the carriage assembly 30. The operator in using the apparatus, would be required to emplace fasteners on a number of garments for example, of a given size. The operator would initially move the index markers 50 and 51 associated with the moveable guide mechanisms 45 and 46 to the proper size by aligning the point end of the index markers 50 and 51 with the size markers as 52 on the carriage assembly 30.

For purposes of the present explanation, it will be assumed that the turret assembly 80 of FIG. 2 has also been properly set. In order to emplace the garment, the operator would take the bottom edge 101 of the garment and align the corner of that edge with the inverted "L" guide member 47. The operator holds the garment between the edge 101 and the point at the beginning of the crotch area as 102 to assure that the material between these two points is relatively taut. With the top corner of the edge 101 positioned as shown in the FIG. and the other point 102 positioned as shown, the operator would then activate the foot switch 92. The activation of the foot switch 92 would energize the pneumatic cylinder or solenoid 43 to exert a downward force at the edge of the clamp 35. This clamp 35 would close to secure the garment on the carriage assembly as shown.

The next thing the operator would do is to grasp the corresponding corner 103 of the other leg and hold the material taut by grasping a section near the crotch as 104 and thus align the right corner 103 with the "L" shaped guide 48 associated with the right index mechanism 46. This would be done with the foot pedal held down. Thus, while the operator is emplacing the garment on the right hand side of the carriage assembly, the left clamp 35 is activated to hold the garment as indicated.

As soon as the right side of the garment is emplaced as shown, the foot switch 92 is released. This activates the right cylinder or solenoid 44 to thus impress a downward force on clamp 36 to cause the fingers 38 associated with the clamp to hold the garment in the position shown.

As can be seen, due to the manner in which the operator places the garment by first aligning the left corner and then the right corner, all the excess material accumulates at the crotch area or that area in close proximity to the center pivot point 36. This aspect of clamping the garment is extremely important as the distance between the "L" shaped clamps 47 and 48 may be up to two feet and hence, the sequential clamping of the left and then the right side enables the operator to simply and accurately align the garment in spite of its length and shape.

Shown in phantom and located beneath the garment is the slot 34. Also shown is the location 27 of the emplacement tool associated with the snap fastener attachment machine 20.

It is, of course, understood that the punch and the associated top part 26 of the fastener are located directly above the area 27.

Thus, the first sequence in employing the apparatus has been shown as clamping the garment on the movable carriage assembly 30 by means of the sequential operation of the clamps 35 and 36. It is, of course, understood that the operator, if desired, could have emplaced the garment from right to left and the machine could operate to first activate the clamp 36 via the solenoid 44 and then the clamp 35 via the solenoid 43.

As shown in FIG. 2, associated with the control sequencer 90 is a control panel 91. The control panel 91 contains a number of buttons or switches designated as RET for return, RESTART, CLAMP, ADVANCE, SINGLE, STACKER, START and STOP. The functions of these buttons in conjunction with the sequence of operations will be described below.

For the present purposes and after the garment has been clamped as described above, the operator now depresses or activates the START button. The following sequence of events occur:

The control sequencer 90 activates the air cylinder or solenoid 93 and the carriage is moved a predetermined distance to the right. This distance is automatically predetermined and is distance B shown in FIG. 1. For each size that the machine is to accommodate as determined by the settings of the size indexes, the first fastener is to be emplaced a predetermined distance from the edge of the left leg as depicted by B of FIG. 1. The function of the air cylinder 93 is to move the carriage initially to the right so that the edge of the "L" shaped gauge 47 is at a distance B from the emplacement area 27.

As soon as the cylinder 93 moves the carriage the proper predetermined distance to the right, the linear actuator 70 is energized and begins to move from block 72 towards block 73 or from left to right. As the actuator 70 moves, the bracket 68 which is rigidly coupled to the belt 61, causes the belt to move. As can be seen, the motion of the belt 61 about the idler assembly causes the carriage assembly 30 to move from right to left or in the opposite direction as the actuator.

As soon as the actuator approaches a cam as 83 on the turret assembly 80, the actuator arm moves upwardly. The movement of the actuator arm 76 as will be further explained, causes a control signal to be provided. This control signal may be furnished by means of a switch closure and so on and in essence, indicates that the proper position for emplacement of the next fastener has been acheived.

It thus can be seen that the location of the cam members 83 on the shaft 82 as associated with the turret assembly 80 determine the postiion and location of each fastener to be emplaced on the garment. Thus, when the arm of the actuator 70 contacts a surface of a cam as 83, the emplacement of a fastener is afforded. This is accomplished by sending a signal to the attaching machine 20, which signal indicates that the punch 25 is to be operated. The attaching machine 20, upon emplacement of a fastener automatically causes the next fastener parts to be directed from hoppers 21 and 23 to the emplacement area. The linear actuator then receives a signal from the snap fastening attaching machine that emplacement has been accomplished.

The actuator then continues travelling along the shaft 71 until the next cam is accessed by the actuator arm 76. This then causes the next fastener to be emplaced on the garment at the location determined by the postioning of the cams on the turret shaft 82. Thus, the actuator continues to move along the shaft 71 until the total number of fasteners have been emplaced on the garment of FIG. 3.

The control sequencer 90 responds to each pulse from the attaching machine and stores the pulses in a counter. The contents of the counter determine that the correct number of fasteners have been emplaced on the garment. As soon as the last fastener has been emplaced, the apparatus is automatically reset to its initial condition to permit the operator to then insert an additional garment into the apparatus. The resetting causes the following sequence of events to occur.

The actuator 70 is returned to its left hand position, the clamps 35 and 36 are released and the logic associated with the control sequencer is reset to enable the accommodation of the next garment so emplaced as can be seen from FIG. 3 and as will be described. Once the clamps 35 and 36 are released, the garment due to the weight of the excess material depending from carriage assembly 30, falls off the table and has positioned thereon the proper number of snap fasteners on one edge of the garment extending from the left edge of leg 101 to the edge of 103.

An identical machine can then be employed to emplace the corresponding fasteners near the edge of the corresponding side of the garment. Thus, a row of fasteners as 15 of FIG. 1 are first emplaced in a single sequence as described about the periphery of the garment and a second row of fasteners as 16 are then emplaced by a second machine operating substantially as the apparatus described above.

FIG. 4 shows a diagramatic top view of the actuator 70 and arm 76 traversing the support rod 71. As can be seen from FIG. 4, the cam members as 83 are trapezoidal in shape to allow the actuator lever 73 to coact with the surfaces easily and conveniently and to allow the return of the actuator 70 upon completion of the snap fastening attachment cycle. FIG. 4 shows the bracket 68 secured to the actuator 70 housing and coupled to the belt 61 to move the same for movement of the actuator 70 along the shaft or rod 71.

Referring to FIG. 5, there is shown a side cross-sectional view of an actuator 70 mechanism in order to depict one technique of permitting an actuator as 70 to traverse a rod as 71.

The technique of moving a housing along a shaft as 70 is one of many embodiments which can be employed and many suitable techniques for moving a carriage or housing as 70 along a shaft as 71 are known in the prior art and have been used and employed in facsimile systems, typewriters and machines of all sorts and nature.

The actuator 70 has a central shaft accommodating aperture 120 which encircles the shaft 71. The housing of the actuator 70 may be weighted in the lower end to stabilize the same about the shaft 71 to prevent rotation or may employ an extending arm 126 which encircles a track 125 to prevent rotation of the actuator 70 when traversing the rod 71.

Figure 6:
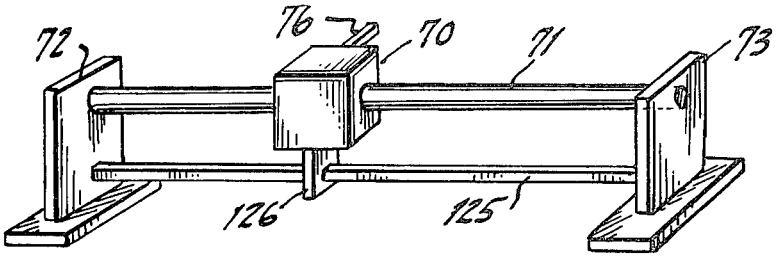
FIG. 6 is a perspective view of an actuator and shaft assembly.

FIG. 6 shows this feature in a perspective diagrammatic view. The actuator 70 has the extending bottom bracket 126 which encircles a rectangular or square cross-sectional shaft 125 directed parallel to rod 71. The bracket 126 as encircling the shaft 125 prevents rotation of the actuator 70 as it traverses the rod 71.

Referring to FIG. 5, the actuator 70 is shown in a rectangular housing, although any other suitable configuration may be envisioned. The actuator 70 has secured thereto, two D.C. motors 130 and 131 which are rigidly secured to the actuator housing. The shafts 132 and 133 of the motors are coupled to rubber, or pliable driving rollers 134 and 135. The rollers 134 and 135 are forced in contact with the sides of the shaft or rod 71. When power is supplied to the motors from the control sequencer 90 via the connecting cable 136, the motors energize and the shafts rotate the rollers to propell the housing and actuator 70 along the rod 71. Although two motors are shown, it is seen that one motor may be employed as well to thus drive the actuator 70 along the rod 71. As indicated, many alternate driving mechanisms exist and are known in the art. If the polarity of the voltage to the motors is reversed (i.e. from plus to minus or vice versa), the direction of rotation changes and hence the actuator can traverse the rod 71 from left to right or from right to left.

Also shown associated with the actuator 70 is the arm 76. The arm 76 is pivotably mounted within the housing and biased at a normally relatively horizontal position by means of a spring or otherwise. The arm 76 can rotate or pivot upwardly and if the upward movement is large enough, the shaped end 76A of the arm 76 will exert pressure on the arm of a pressure activated switch 140 to close the same. The leads 141 and 142 from the switch contacts are directed via a cable to the control sequencer 90 and the attaching machine 20 to provide the attaching machine control signal described above.

Thus, the function of the arm 76 is to coact with the cam surface 83 to close the switch 140 at the proper time to thus cause a signal used to operate the die associated with the snap fastener attaching machine at the correct time and position.

Figure 7:
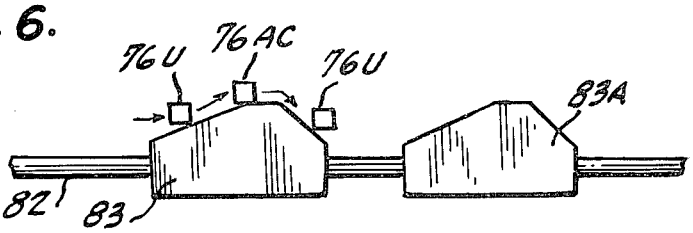
FIG. 7 is a partial view of a turret cam member useful in explaining the operation of an actuator used with this invention.

FIG. 7 shows one type of cam 83 surface configuration which can be employed on the turret assembly 80 on a given shaft as 82.

The cam 83 when rotated into position on the shaft 82, has a first rising surface upon which the actuator arm 76 rides until it reaches a predetermined height due to its pivoting and designated as 76AC or 76 actuate. At this point 76AC, the arm 76 operates the switch 140 to provide the control signal to operate the punch. When the actuator proceeds in its travels, the arm 76 falls due to the sloping back of the cam to its neutral position as 76U and hence, the switch 140 is not operated.

The same sequence occurs when the actuator 70 is moved towards the next cam 83A along the shaft 82.

As seen, the shafts have a smaller taper at the rear to permit the actuator arm 76 to traverse the cams when the actuator returns to its neutral position for the start of a new sequence. This can also be accomplished by a solenoid in the housing of the actuator 70 which would pivot the arm upwardly at the end of the sequence and prior to returning the actuator to the neutral position.

Figure 8:
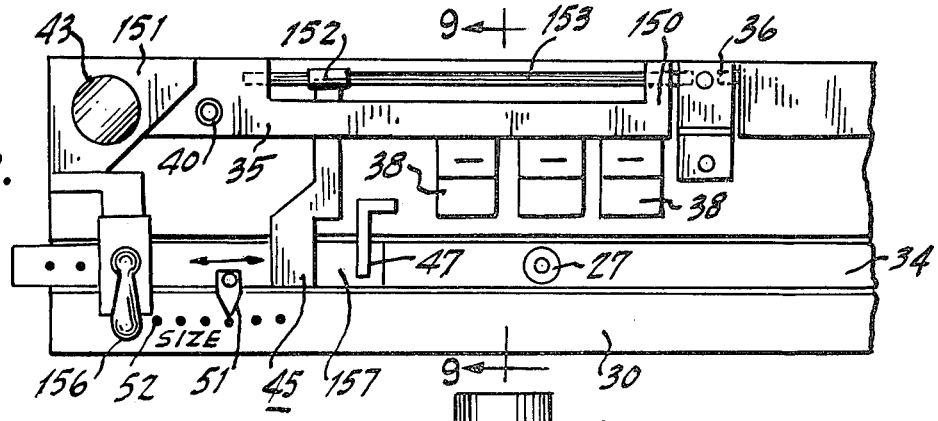
FIG. 8 is a top plan view of a left-handed clamp assembly according to this invention.

FIG. 8 shows a partial view of the left handed clamp assembly 35 on the moveable carriage assembly 30. The right handed clamp assembly 36 is virtually the same as above indicated, but operated in sequence.

The guide mechanism 45 is shown in detail and basically rides in the slot 34 which communicates with the emplacement tool area 27 or fastener part location of the attaching machine 20. The spring steel clamping fingers 38 are directed beyond the top of the inverted "L" gauge block or bar 47 so that when the operator emplaces the garment on the carriage assembly table 30, the garment is secured. A pivot bar 153 is pivotally mounted to block 36 and block 151 to allow pivoting of the clamp bar 35 with respect to the carriage 30. The solenoid or air cylinder 43 is mounted on a platform 151 integral or rigidly secured to the carriage assenbly 30. The spring 40 permits the biasing of the clamp 35 in the open position prior to activation of the solenoid 43. The guide mechanism 45 includes a bar 157 to which the block 47 and index member 51 are secured. The bar 157 can be adjusted or moved in the slot 34 by means of the catch or release 156, which is a simple bolt or latch mechanism to lock the assembly within the slot. The gauge bar 157 has attached thereto an extending arm 152 which encircles the bar 153 to permit accurate and reliable movement and placement of the guide mechanism 45.

Figure 9:
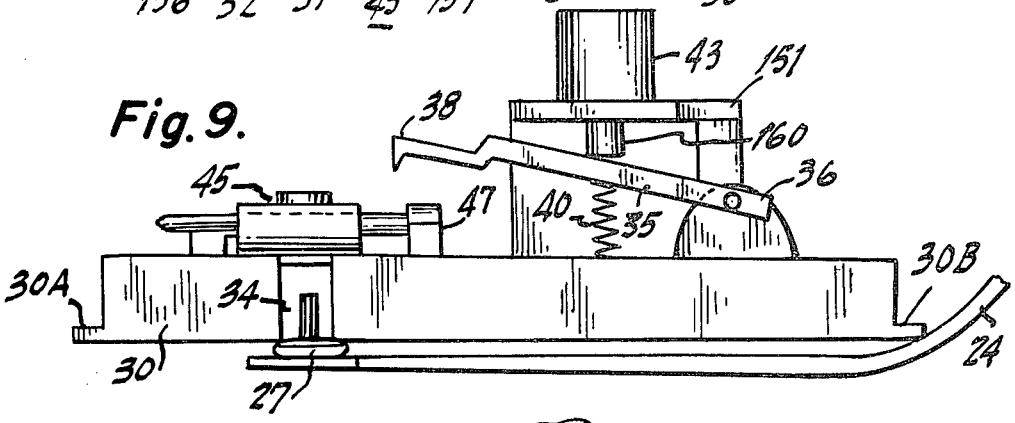
FIG. 9 is a side view of a clamp assembly taken through line 9—9 of FIG. 8.

FIG. 9 shows a simple cross-sectional view of the clamp and the carriage assembly to show the operation of the solenoid or air cylinder 43 in conjunction with the clamp 35. Essentially, the arm or bolt 160 of the solenoid 43 rests against the top of the clamp bar 35. The clamp bar is held upwardly by the bias spring 40. Upon activation of the solenoid 43, the bolt 160 pushes the clamp downward thus permitting the fingers 38 to grasp and hold the garment when emplaced. Also shown is the hopper conveyor 24 directed beneath the slot 34 and a fastener part positioned by the attaching machine at the area 27.

Figure 10:
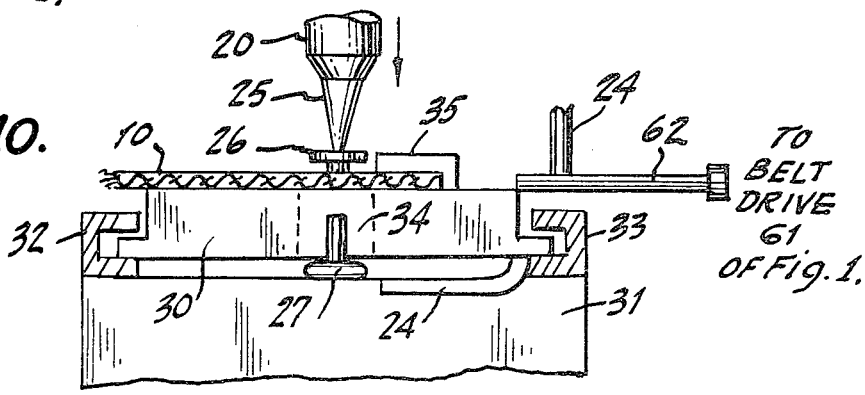
FIG. 10 is a diagrammatic side view useful in explaining the attachment of a fastener to a garment as implemented by the apparatus.

FIG. 10 depicts a simplified side view for showing the attachment of fastener parts to a garment. As indicated, the attachment machine 20 aligns a top fastener part 26 and a bottom fastener part 27 above and below the clamped garment 10. The carriage 30 with the slot 34 permits communication between the parts and the garment. When the machine 20 receives the control signal, the punch or die member 25 is moved downwardly to emplace the parts on the garment in the position determined by the movement of the carriage 30 as controlled by the actuator 70. As can be seen in FIG. 10, the carriage 30 is carried by and moved within the side rails 32 and 33 attached to the machine base or bed 31.

Accordingly, apparatus for emplacing a predetermined number of fastener parts on a bias as on the edge of the continuous piece of material between two legs of a youngsters article of clothing such as described in FIG. 1, as has been explained. It is here noted that many other articles of clothing which require fasteners such as mens jackets, sweaters and so on can be employed in this apparatus to emplace fasteners on one edge of the material in predetermined positions commencing from a first starting position at regularly spaced intervals determined according to the positioning of the cams on the turret assembly.

As indicated above, the turret assembly may contain many shafts with different cam arrangements to accommodate the various different sizes. The turret assembly and the associated cams operate in conjunction with the gauge mechanisms on the carriage assembly to adjust to the length or size of the particular garment which is to be clamped edge to edge via the right and left clamp assemblies.

In the case of a youngsters garment, the accumulated or excess material, due to the fact that it is not linear, is gathered at the crotch area based on the emplacement of the garment by the operator. Hence, as described above, in employing such apapratus an operator can emplace a complete row of fasteners as those fasteners designated as 15 of FIG. 1, about one peripheral edge of the garment.

In any event, in order to complete the manufacturing process, the operator would be required to emplace fasteners as 16 of FIG. 1 on the corresponding edge of the garment. These fasteners 16 as shown in FIG. 1 will therefore communicate with the fasteners 15 to enable closure of the leg seam area when the garment is worn by a user. In order to accommodate this, an identical machine is employed in operation.

Figure 11A:
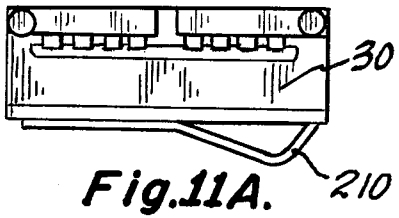
FIG. 11A is a top view of a moveable carriage assembly employing a bowed bar.
Figure 11:
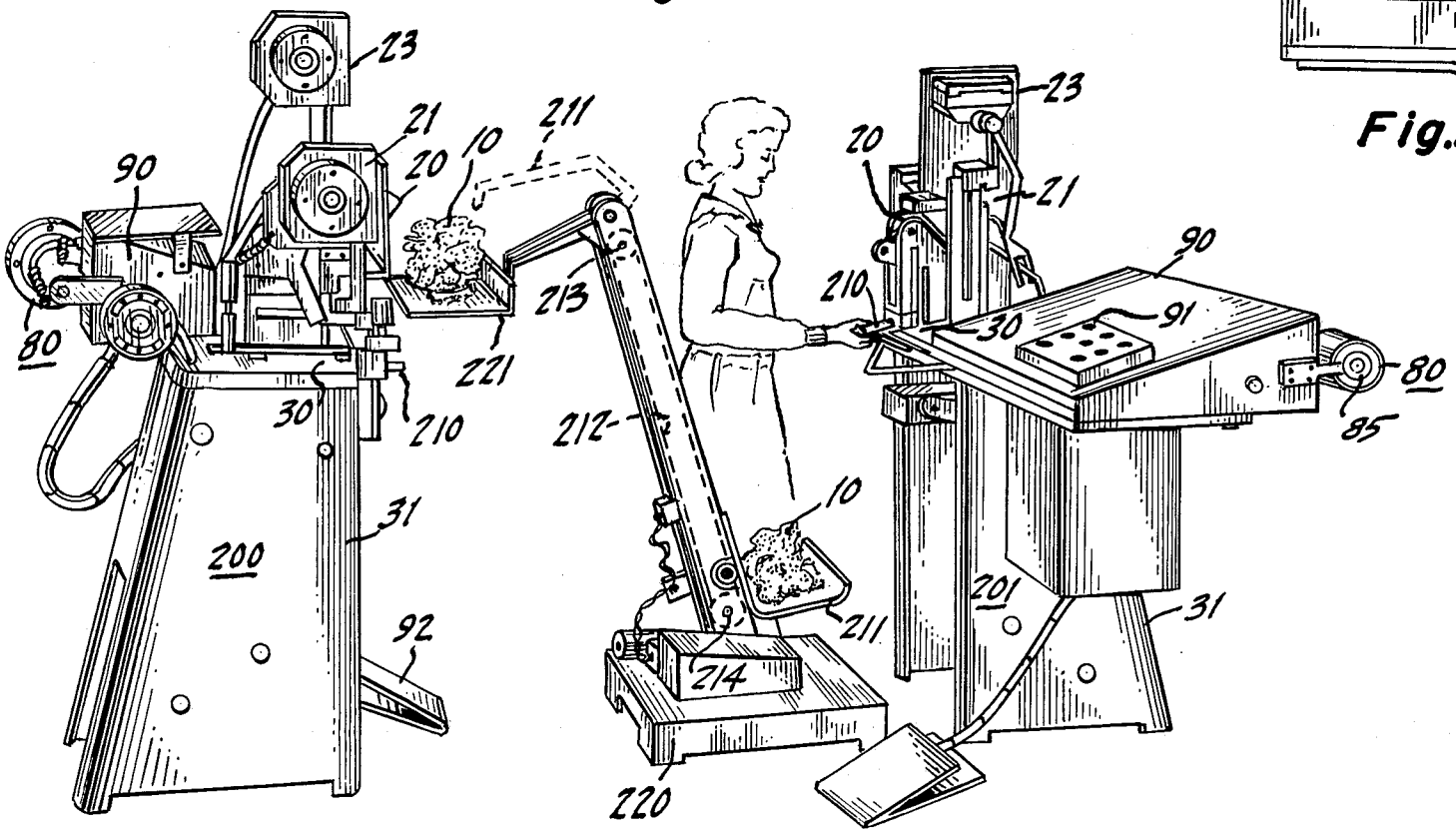
FIG. 11 is a diagrammatic view of an automatic system according to this invention employing a conveyor between two snap fastener attachment machines.

Referring to FIG. 11, there is shown a typical in plant assembly technique using two relatively identical machines for performing the emplacement of fasteners as shown in FIG. 1. Similar numerals have been retained to describe generic parts of the unit as will be explained.

Essentially, FIG. 11 depicts the apparatus in a relatively aesthetic view indicating the general operation of such equipment. The appropriate corresponding parts as indicated in FIG. 1 have been designated on FIG. 11 to enable one to correlate the general functions.

As can be seen, the turret assembly 80 is mounted behind the control sequencer 90 housing. The housing 90 contains the control logic, belt drive 61, the actuator 70 and associated shafts 71. The turret assembly can be rotated conventionally by means of the knob 85 which is exposed to view.

Shown generally is the attaching machine unit 20 with its associated hoppers as 21 and 23 and the carriage assembly 30. Essentially, there are two machines which are designated as 200 for the left machine and 201 for the right machine. An operator stands between both machines and as shown in the FIG., is in the process of emplacing a garment in machine 201 to thereby emplace fasteners along one peripheral edge of a garment.

As indicated above and shown in association with machine 200 is a foot switch 92. There is also a foot switch as 92 associated with machine 201. The operator, upon properly emplacing the left side of the garment depresses the foot switch to activate the left clamp. The operator then emplaces the right edge of the garment and releases the foot switch to activate the right clamp. The operator then presses the START button on panel 91 and the fasteners are emplaced accordingly. During the stacker operation which is associated with a button or a switch on the control panel 91, the garment after emplacement of the fasteners, falls off the carriage assembly 30 due to its weight, as indicated.

As shown in FIG. 11A associated with the carriage assembly 30 may be a bowed bar 210. The garment rests on this bar and is forced to the right or the bowed end 210 as the carriage moves, thus assuring that the garment will drop when the clamps are released.

Shown positioned between the machines 200 and 201 is a conveyor assembly 212. The conveyor has a bottom garment accommodating bin 211 which is pivotably attached to a chain drive 212 which encircles two pulley arrangments or drive gears 213 and 214. The gear 214 is motor driven. The entire conveyor assembly rests on a base 220, which base contains control relays and the motor for driving the conveyor. In the stacker mode as will be explained further, at the termination of the emplacement cycle and as the actuator is being returned to its initial position, the conveyor motor is activated as the garment has fallen into the bin 211 located beneath the appropriate area of the machine 201. The activation of the conveyor motor causes the bin 211 to move to its dashed line position and to pivot, thus dropping the garment into a catch bin or member 221.

The operator can now turn and emplace the appropriate fasteners on the corresponding other edge of the garment by utilizing the relatively same machine as 200 as shown in FIG. 11. After this emplacement is made, the garment is finished and is placed in a finished stack.

When the conveyor, of course, reaches its top point as indicated by the dashed lines, the motor polarity is reversed and the conveyor returns the bin 211 to the position shown in the FIG. and it is now ready to receive the next garment. In this manner, one operator can emplace fasteners on both edges of a garment in a simple and reliable procedure. The garment is automatically transported by means of the conveyor 212 from one machine to the other to enable the operator to sequentially complete the attaching operation. The resulting system therefore as shown, operates relatively automatically as it is custom gauged and designed to meet normal production requirements. The conveyor 212 serves as an automatic handler to carry the garment from one feeder attaching machine as 201 to the other feeder attaching machine as 200.

These features are present with the further advantages of the relatively simple and positive indexing features which permit an unskilled operator to easily change space settings to accommodate a variety of sizes normally present in a typical manufacturing facility.

Figure 12:
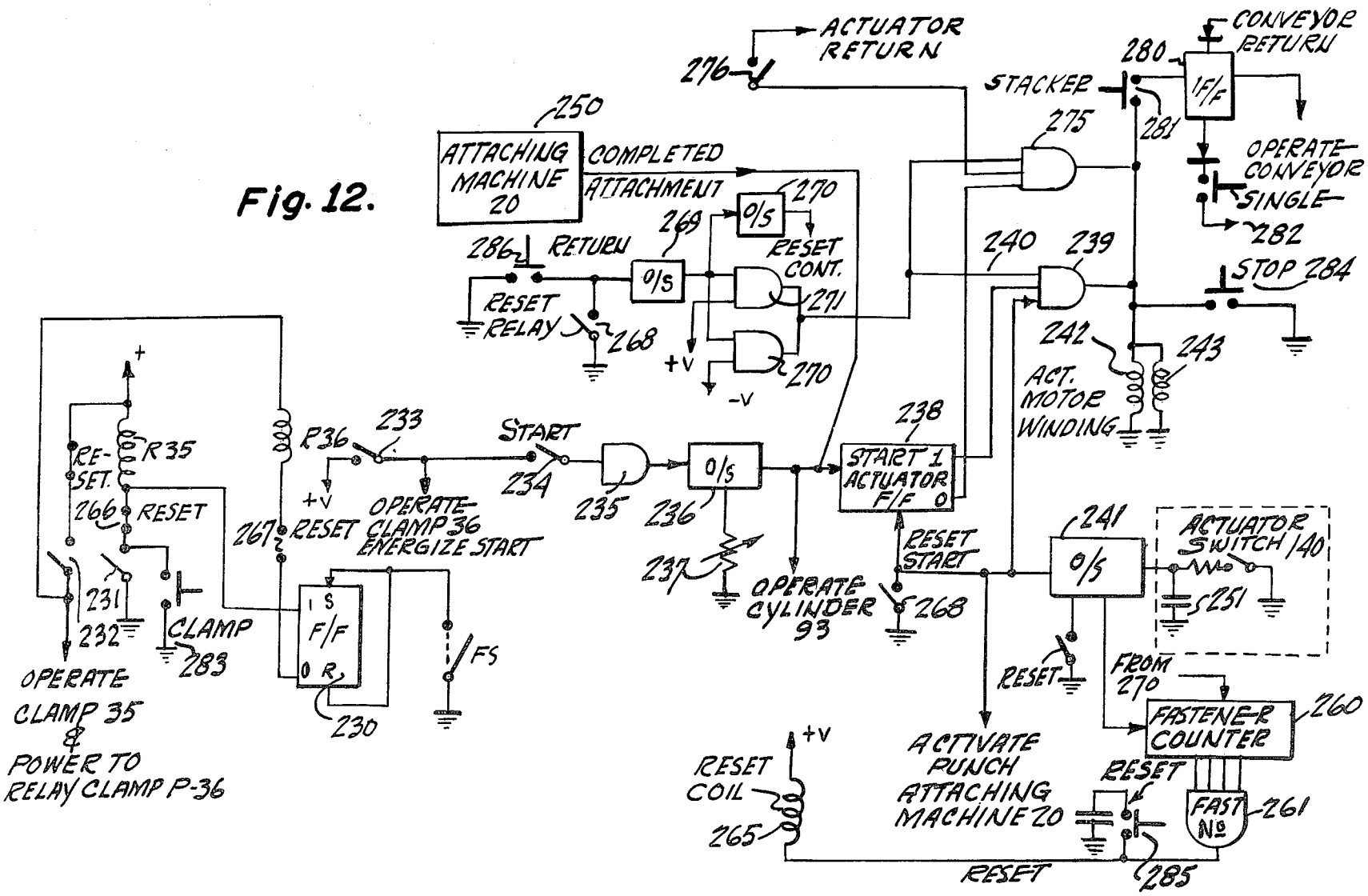
FIG. 12 is a representative circuit schematic showing the circuitry capable of implementing and controlling the operation of a system according to this invention.

Referring to FIG. 12, there is shown a logic diagram which implements the control functions provided by the control sequencer 90 as associated with the control panel 91 and the foot swtich 92. The system operates as explained, in conjunction with various signals which are provided for in the actuator 70 and as will be explained, in the attaching machine 20.

While the logic diagram is presented in the form of conventional electronic components and assemblies including relays in certain instances, it will be noted at the onset that any type of logic system may be substituted therefor. Hence, one may utilize or employ time delay relays in lieu of monostable multivibrators or latching relays in lieu of bistable multivibrators and so on. It is also noted that pneumatic logic employing valves and air pressure actuated cylinders may be employed in lieu of electromechanical solenoids and relays.

In any event, the logic systems operate much faster than the actual mechanical components associated with such attaching machines such as the operation of the punch 25, the time of travel of the actuator along rod 71 and so on. The operation of the machine once the start button is depressed, is extremely rapid compared to the prior art technique of having an operator emplace fasteners on both edges of a garment according to either the operator's skill or based upon predetermined marks in serted on the garment prior to fastener attachment. Thus, the major limitations in regard to speed of operation of this apparatus are determined by the ability of the operator to emplace the garment prior to clamping of the same. Once the start button is activated, the fasteners are automatically emplaced in their proper positions as described above and the speed of this operation is limited only by the mechanical components of the attachment machine and not by the control electronics or the control logic, whether implemented by electrical circuits, pneumatic circuits, relays and so on.

Referring to FIG. 12, there is shown a foot switch designated as FS which would be analogous to the foot switch 92 of FIG. 2. Assume the operator has properly emplaced the garment between the gauge bar as 47 of FIG. 1 and the central pivot 36 of FIG. 1. The operator now depresses the foot switch FS. This sets a flip/flop or bistable multivibrator 230 which in essence places a ground at one terminal of coil R35. This coil which may be a relay or a pneumatic cylinder is energized due to the fact that the other terminal is connected to a source potential. A contact 231 associated with the coil closes to thereby keep the coil R35 activated. Since the foot switch has been depressed a contact 232 also associated with the coil, also closes and serves to activate the solenoid 43 associated with the clamp 35. The solenoid 43 then, as indicated in FIG. 9, pushes the clamp so that the fingers of the clamp secure the left side of the garment. The contact 232 also supplies an operating voltage to coil R36, which coil is associated with the right hand clamp 36 and solenoid 44.

The coil R36 is not energized due to the fact that the flip/flop 230 is still held set because the operator has still maintained pressure on the foot switch. As soon as the foot switch is released, the flip/flop 230 is reset and hence, zero output places a ground on the other side of the coil R36. The coil is now energized due to the fact that power is applied to contact 232 and ground is now applied via the bistable circuit 230. The operation of the relay coil R36 closes contact 233 and hence, energizes the solenoid 44 associated with the right clamp 36. Thus the right clamp closes to secure the garment on the carriage assembly 30.

Relay contact 233 also supplies operating power to the start button 234. The operator is advised that after the garment is clamped and the foot switch released, the start button is to be depressed. Upon closure of the start button or depression of the start button, the voltage +V via contact 233 is applied through an isolation gate 235 to a one shot or time delay relay 236. This one shot 236 produces a predetermined length pulse for a predetermined duration which operates the solenoid or cylinder 93 of FIG. 2 to thus pull the carriage assembly to the right according to the predetermined distance required in each garment for emplacing of the first fastener which is the distance B indicated in FIG. 1.

The one shot, if desired, may have a variable time duration indicated by the control 237 which can be adjusted if necessary, according to the garment size. If a time delay relay were employed, the same adjustment could be afforded.

At the end of the time delay afforded by the one shot 236, a start actuator flip/flop 238 is triggered. One output of the start actuator circuit is coupled to an AND gate 239. The gate 239 has another input 240 coupled to a motor voltage control circuit as will be explained further.

For the present purposes, it is sufficient to indicate that input 240 is receiving a positive voltage to enable the motor associated with the actuator 70 to be energized in a direction to move the actuator along the shaft 71 from left to right. Another input to the AND gate 239 is derived from a one shot or time delay relay 241 which at the inception of the start cycle, provides an enabling voltage to gate 239. Thus, gate 239 is activated when the bistable start actuator circuit 238 is triggered after the cylinder 93 has been operated. The activation of gate 239 supplies operating potential to the motor windings 242 and 243 associated with the actuator unit 70 and designated in FIG. 5 as motors 130 and 131.

Thus, the actuator beings to move along the shaft 170. As soon as the actuator moves into contact with the first cam on the turret assembly 80 as selected by the detent knob control 85, the actuator switch 140 closes when it reaches a position as indicated in FIG. 7 for example, as 76AC. The closure of the actuator switch triggers a one shot or time delay relay 241.

Relay 241 thus triggered, sends a suitable length pulse to the attaching machine 20 of sufficient amplitude and duration to cause the punch 25 to emplace a fastener. The actuation of such attaching machines by remote signals is well known. Essentially, a prior art attaching machine such as the model 6N performs emplacement by the operator depressing a foot switch which is simply a contact closure. Thus, the signal obtained from the one shot 241 is completely analogous to the closure of that foot switch and causes the attaching machine to emplace the fastener when the actuator switch provides a signal. As soon as the attaching machine 20 has completed its cycle, it returns a signal to the control sequencer logic. This signal is indicated by module 250 and may be developed in the attaching machine by many known techniques and also is known in the prior art.

Basically, the attaching machine has a clutch mechanism which includes a cam. The cam moves as the punch 25 is thrusted into the emplacement area. When the cam completes its cycle, the punch is returned and a momentary switch may be activated to provide the completed attachment signal as emanating from module 254. This signal retriggers the start actuator flip/flop 238.

As shown on the diagram, when the one shot 241 is fired, the start actuator flip/flop is reset immediately. Thus power is removed from the motor windings 242 and 243 due to the fact that the gate 239 is disabled. As soon as the control logic receives the completed attachement signal, the bistable circuit 238 is triggered again, thus again enabling the start actuator circuit 238 and gate 239 to supply operating potential to the motor windings 243 and 242. Thus, the actuator now moves from the cam and commences along the rod 71 to the next cam contained on the rod.

It is noted that even though the switch 141 as indicated for example, in FIG. 7, goes from a closed to and opened position, the one shot 241 will not fire again due to the fact that the polarity from closed to opened is incorrect.

Also shown associated with the actuator switch 140 is an antibounce circuit 251 which assures that momentary bouncing of the switch contacts will not trigger the module 241.

Also shown is a fastener counter circuit 260. The fastener counter circuit is coupled to a one shot 241 and stores a count each time the one shot 241 is fired. This, of course, is representative of the emplacement of a fastener. Thus, it is known by examining the contents of counter 260 how many fasteners have beem emplaced. As the actuator travels along the shaft 71, the actuator arm as explained contacts each cam located on the turret and hence, each time the actuator switch closes, a fastener is emplaced and the actuator moves on to the next cam to enable emplacement of the next fastener. When the proper number of fasteners have been emplaced, the fastener counter 260 has stored therein this number. The contents of the fastener counter are decoded by a fastener decode gate 261. Hence, when the proper number of fasteners have been emplaced on the garment, gate 261 is enabled. The enabling of gate 261 energizes the coil of a reset relay 265. The following sequence of events occur:

A contact 266 of the reset relay 265 is in series with the coil R35 and another contact 267 is in series with the coil R36. Upon activation of the reset relay 265, these contacts open. Thus, relays R35 and R36 are deenergized and hence, the clamps 35 and 36 open and the garment is released. This action happens relatively rapidly at the end of the cycle.

The reset relay also has a contact 268 which resets the start flip/flop 238 to disable gate 239. In any event, closure of contact 268 also serves to trigger a time delay relay or one shot 269 associated with the motor power circuit as will be described.

A motor power circuit comprises two gates 270 and 271 which are controlled by the one shot or time delay relay 269. Mainly, the time delay relay is only fired when the reset relay 265 is activated. Hence, during normal operation as for example, upon the start of the sequences, gate 271 is activated. This supplies a positive +V voltage to lead 240 for gate 239 to thus permit the actuator motors to be driven from left to right for this voltage polarity. During the firing of the one shot 269, gate 271 is disabled and gate 270 is enabled. This supplies a negative voltage on lead 240 which further blocks gate 239 to prevent the actuator from moving any further in a positive direction. This negative voltage is also applied to another gate 275. Gate 275 has its outer input coupled to the reset side of the bistable circuit 238. Hence, gate 275 is enabled when the start circuit 238 is reset and when the reset relay 235 is activated.

Gate 275 also has an input coupled to an actuator return switch 276. The switch 276 is opened as shown for all positions of the actuator other than its start position and therefore due to the opened condition of switch 276, the gate 275 is enabled, except when the actuator is at its start position as will be explained.

Gate 275 then supplies a negative potential to the motor windings 242 and 243. This reverses the direction of rotation and causes the actuator to travel back to its initial position during the time that the one shot 269 is activated. At the termination of this time period, it is noted that as the actuator returns to its initial position, actuator switch 140 will open and close but the one shot 241 will not trigger as it is inhibited by the reset relay.

When the actuator returns to its intial position, the housing is brought into contact with a microswitch which closes. This is designated as switch 276. The closure of the switch inhibits gate 275 and this stops the actuator at its correct initial position. The switch 276 will remain closed while the actuator is activated again to begin travel back down the shaft 71.

When the actuator is returned to its initial position during the time duration afforded by the one shot 269, a one shot 270 is triggered at the end of the period determined by the one shot 269. The one shot 270 resets the counter 260 to all zeroes, disables the decode gate 261 and thus the relay 265 is deactivated and the system is now ready for the next garment as all circuits have been set to their quiescent conditions. Thus, the depression of the foot switch FS will again activate the left clamp and so on to enable the system to perform another operating sequence.

As previously indicated, there are other control switches on the control panel 91 and their functions and uses will be briefly described.

Also shown coupled to gate 275 is a flip/flop or a bistable circuit 280. As can be seen, a switch 281 designated as a stacker is in series with the input to the bistable 280. Hence, if one activates the switch 281, the bistable circuit 280 will be triggered when the carriage is being returned by the return of the actuator. The activation of the bistable 280 sends a signal to the conveyor motor to operate the same, as the garment has been released and has dropped into the bin 211 associated with the conveyor. When the conveyor completes its operation whereby the garment has been transported between two machines as described in FIG. 11, a return pulse designated as conveyor return resets the bistable 280. If the stacker switch remains depressed the conveyor will operate at the end of each cycle to transport the garment. If the operator does not wish the conveyor to operate, as the operator may desire to only emplace a single line of fastners using only one machine during the course of the work period, then the single button 282 would be depressed. This would inhibit the activating of the bistable 280 and hence, prevent conveyor operation during this mode.

Also shown in FIG. 12 is a clamp switch 283 which appeared on the control panel. If this switch is operated, both both the relays R35 and R36 will be activated to thereby operate both the clamp solenoids. This may be used to test the clamp operation or to enable an operator to align an unbiased garment in a single operation. It is noted that the clamp switch will operate the clamps without the necessity of depressing the foot switch FS.

A further control button 284 is designated as the stop button and essentially puts a ground on the windings 243 and 242 associated with the actuator motors. Hence, the depression of the stop switch will stop the entire system from movement at any point desired. When the switch is released, the operation will continue from that point as all other circuits will not be affected by the operation of the stop switch 284.

Also depicted is a reset switch 285 which as can be seen, functions to operate the reset relay 265. The operation of this relay as above explained causes the entire system to return to its initial condition and this will occur at any point in the travel of the carraige and actuator.

A further switch 286 designated as a return switch enables the triggering of the one shot 269 to thereby return the actuator to its initial position at any time the switch is depressed. This therefore enables an operator to emplace a lesser number of fasteners if desired, and further helps in assuring that the machine is operating correctly prior to using the same in a manufacturing procedure.

As indicated above and as can be ascertained from the logic presented herein, there are many ways of implementing the control signal by using various different types of logic devices as well as by emplacing switches at various other points in the circuitry. Thus, for example, one could trigger the bistable 280 from the reset relay if desired, by coupling the input to the circuit 280 through the series stacker switch to a contact of the reset relay. This therefore, would enable the conveyor to begin operation as soon as the clamps are released and prior to the return of the carriage and actuator to its initial position.

It is therefore understood that based on the above described sequences and operation that many alternate embodiments would become apparent to those skilled in the control circuitry art and hence, all such equivalents in operation are deemed to be encompassed within the bounds and scope of the apparatus described above.

I claim:

1. A method for attaching snap fastener parts along an irregularly shaped material edge located between a first end and a second end, comprising the steps of:
   (a) first clamping said material from said first end towards said second end for a given distance along said edge,
   (b) then clamping said material from said second end towards said first end for a given distance along said edge whereby all material not clamped is accumulated between said first and second ends, and
   (c) emplacing snap fastener parts at predetermined intervals only along said clamped edges in a direction commencing from said first end to said second end whereby said material not clamped has no fastener parts attached thereto.

2. The method according to claim 1 further comprising the step of aligning a first end edge of said material with reference to a first guide means prior to first clamping said material.

3. The method according to claim 2 further comprising the step of aligning the other end edge of said material with reference to a second guide means after said first clamping and before the step of said then clamping.

4. The method according to claim 1 wherein the step of emplacing said fastener further includes moving said clamped material in a given direction during emplacement.

5. The method according to claim 4 comprising the step of first moving said clamped material a predetermined distance in a direction opposite said given direction to define a position for emplacement of a first fastener and thence emplacing fasteners by moving said clamped material in said given direction.

6. The method according to claim 1 further comprising the step of counting the number of fasteners emplaced and ceasing emplacement when said counted number equals a preselected value.

7. The method according to claim 6 comprising the further step of releasing said clamped material after ceasing said emplacement.

8. The method according to claim 7 comprising the further step of transporting said material after releasing the same to another emplacement area.

9. A method of emplacing snap fasteners about an edge of a pants-like garment, said edge being an inner seam of an inverted "V" shaped configuration formed between two leg portions of the garments, comprising the steps of:

(a) aligning and clamping said garment from the end edge of one of said leg portions and for a predetermined distance towards the center of said "V", then (b) aligning and clamping said garment from said other end edge of said other leg portion and for a predetermined distance towards the center of said "V", to cause any excess material of said garment not clamped to accumulate relatively at the center of said "V", (c) first moving said garment a predetermined distance from said end edge of said one of said leg portions to define a location for a first fastener, (d) emplacing said first fastener at said location and thence (e) inserting additional fasteners at predetermined intervals only about said edges as clamped, whereby no fasteners are emplaced at said location of said excess material.

10. The method according to claim 9 wherein said garment is a youngster type garment with said inner seam between said leg portions to have fasteners emplaced thereon to assist a user in opening said seam.

11. The method according to claim 9 wherein the step of inserting additional fasteners includes moving said clamped garment in a direction opposite to said first moving to emplace fasteners at predetermined intervals as said garment is moved.

12. The method according to claim 9 further comprising the step of counting said first and additional fasteners as emplaced and storing said count and ceasing emplacement when said stored count equals a preselected integer.

13. The method according to claim 12 further comprising the steps of unclamping said garment when said emplacement ceases and transporting said garment to another emplacement area.

14. The method according to claim 11 including the further step of monitoring the distance moved according to predetermined intervals to emplace a fastener at a position determined by said monitoring.

15. A method for attaching corresponding snap fastener parts to a garment, said parts to be emplaced along a predetermined edge of said garment, said edge characterized by a first end and a second end with an irregular shaped continuous curve of a predetermined length between said first and second ends, comprising the steps of:

(a) aligning said first end with respect to a first guide member, (b) clamping said material along said garment edge from said first end for a given length less than said predetermined length, (c) aligning said second end with respect to a second guide member located relatively parallel with said first guide member and separated therefrom by a distance less than said predetermined distance, (d) clamping said material along said garment edge from said second end for a given length less than said predetermined length, to cause any excessive length of said material to be accumulated between said first and second ends and between said clampled lengths, and (e) emplacing fastener parts at predetermined intervals only along said clamped edges, whereby said accumulated material has no fastener parts emplaced thereon.

16. The method according to claim 15 wherein the step of emplacing said fastener parts further includes moving said clamped garment in a given direction, monitoring said movement to indicate selected intervals and emplacing fastener parts at said intervals according to said predetermined intervals.

17. The method according to claim 15 further comprising the step of counting the number of fastener parts emplaced and comparing said number with a preselected number, ceasing emplacement when said counted number equals said preselected number, unclamping said garment when emplacement is ceased and transporting said garment to another attaching area.

18. The method according to claim 15 further comprising the step of moving said clamped garment, prior to emplacing, a predetermined distance for defining the location of the first fastener to be emplaced and thence emplacing said first fastener at said location and to thereafter emplace fastener parts at said predetermined intervals.

19. The method of claim 15 wherein said material is clamped on a planar member having a longitudinal slot over which said material is clamped to define an emplacement location.

20. A method for attaching corresponding snap fastener parts to a garment, said parts to be emplaced along a predetermined edge of said garment, said edge characterized by a first end and a second end with an irregular shaped continuous curve of a predetermined length between said first and second ends, comprising the steps of:

(a) aligning said first end with respect to a first guide positioned on a moveable planar member, (b) clamping said material on said planar member and along said edge of said garment from said first end for a given length less than said predetermined length.

(c) aligning said second end with respect to a second guide separated from said first guide and positioned on said moveable planar member, (d) clamping said material on said planar member and along said garment edge from said second end and towards said first end for a given length less than said predetermined length to cause any excessive length of said material to be accommodated on said planar member between said first and second ends, (e) moving said planar member with respect to a fastener emplacement tool to emplace a fastener part only along said clamped edges at predetermined intervals, whereby said accumulated material has no fasteners emplaced thereon.

21. The method according to claim 20 comprising the further step of adjusting the distance between said first and second guides according to the size of said garment and prior to the steps of aligning and clamping.

22. The method according to claim 20 further comprising the steps of counting the number of fasteners emplaced, comparing said count with a predetermined number, ceasing emplacement when said count and said number are equal, unclamping said garment when emplacement is ceased and transporting said garment to another snap fastener attaching area.

23. The method according to claim 20 wherein said garment is clamped above a longitudinal slot located on a surface of said planar member.

24. The method according to claim 20 further comprising the step of moving said member a predetermined distance prior to moving said member with respect to said emplacement tool to designate a first location for the emplacement of a first fastener and thence moving said planar member with respect to said tool.

25. The method according to claim 20 wherein said garment is a youngster-type garment having an irregular shaped inner seam edge about which said snap fastener parts are to be emplaced.

* * * * *